US006966311B2

(12) United States Patent
Hiramatsu et al.

(10) Patent No.: US 6,966,311 B2
(45) Date of Patent: Nov. 22, 2005

(54) IGNITION APPARATUS FOR ENGINE

(75) Inventors: Hiromi Hiramatsu, Kariya (JP); Masamichi Shibata, Toyota (JP)

(73) Assignee: Denso Corporation, Kariya (JP)

( * ) Notice: Subject to any disclaimer, the term of this patent is extended or adjusted under 35 U.S.C. 154(b) by 207 days.

(21) Appl. No.: 10/631,832

(22) Filed: Aug. 1, 2003

(65) Prior Publication Data

US 2004/0055587 A1 Mar. 25, 2004

(30) Foreign Application Priority Data

Aug. 29, 2002 (JP) ..... 2002-251054

(51) Int. Cl.[7] ..... F02P 13/00
(52) U.S. Cl. ..... 123/634; 123/635
(58) Field of Search ..... 123/634, 635, 123/647

(56) References Cited

U.S. PATENT DOCUMENTS

| | | | | |
|---|---|---|---|---|
| 5,146,906 | A * | 9/1992 | Agatsuma | 123/634 |
| 5,535,726 | A | 7/1996 | Wilmot et al. | |
| 6,119,667 | A | 9/2000 | Boyer et al. | |
| 6,122,971 | A * | 9/2000 | Wlodarczyk | 73/705 |
| 6,169,471 | B1 * | 1/2001 | Sakamaki et al. | 336/96 |
| 6,178,957 | B1 * | 1/2001 | Widiger et al. | 123/634 |
| 6,215,385 | B1 * | 4/2001 | Ogden | 336/96 |
| 6,259,344 | B1 * | 7/2001 | Heritier-Best et al. | 123/634 |
| 6,276,348 | B1 * | 8/2001 | Skinner et al. | 123/634 |
| 6,340,303 | B2 * | 1/2002 | Hamada et al. | 439/127 |
| 6,639,498 | B2 * | 10/2003 | Shimada et al. | 123/634 |
| 6,668,810 | B1 * | 12/2003 | St. John et al. | 439/127 |
| 6,694,958 | B2 * | 2/2004 | Hiramatsu et al. | 123/634 |
| 6,724,289 | B2 * | 4/2004 | Moga et al. | 336/90 |
| 6,880,540 | B2 * | 4/2005 | Fuma et al. | 123/634 |

FOREIGN PATENT DOCUMENTS

| | | |
|---|---|---|
| EP | 907 019 | 4/1999 |
| JP | 2000-277232 | 10/2000 |
| JP | 2002-21695 | 1/2002 |

* cited by examiner

*Primary Examiner*—Hai Huynh
(74) *Attorney, Agent, or Firm*—Nixon & Vanderhye P.C.

(57) ABSTRACT

An integrated ignition apparatus has a coil section and a plug section. The coil section has a spring as a connection member internally. The spring electrically connects other inside terminal members of the plug section. When the coil section and the plug section are integrated, the spring is pressed, and resiliently deforms in the axial direction. Spring-back force of the spring maintains electrical connection steadily, and prevents disconnection of the spring and the terminal members due to vibration. This structure prevents failure in electric conduction between the coil section and the plug section.

9 Claims, 12 Drawing Sheets

IGNITION APPARATUS FOR ENGINE

CROSS REFERENCE TO RELATED APPLICATION

This application is based on and incorporates herein by reference Japanese Patent Application No. 2002-251054 filed on Aug. 29, 2002.

FIELD OF THE INVENTION

The present invention relates to an ignition apparatus which has an integrated body of a plug section and a coil section.

BACKGROUND OF THE INVENTION

Conventionally, various kinds of integrated ignition apparatuses were proposed. In the ignition apparatus described in EP 0 907 019 A2, a stem of a plug section contacts a high voltage terminal of a coil section. However, in case that the stem is connected with the high voltage terminal by screwing or crimping, the connection between the stem and the high voltage terminal is apt to be disconnected due to vibration, causing failure in electric conduction.

SUMMARY OF THE INVENTION

In view of foregoing problems, it is an object of the present invention to avoid electric conduction failure between a plug section and a coil section.

In the present invention, a plug section and a coil section are integrated into an ignition apparatus and are mounted on the cylinder head of an engine. The plug section sparks at tip end between a center electrode and a ground electrode. The coil section has a primary coil and a secondary coil, and supplies high voltages to the plug section. When the plug section is joined with the coil section, the center electrode is electrically connected with the secondary coil via connection terminal members. The connection is maintained by spring force, and is not apt to be disconnected. Thus, electric conduction failure can be avoided. The terminal members can be a coil spring, a blade spring, bent wires and so on.

The plug section is included in a plug case. The plug case has a plug-flange. The coil section is included in a coil case as a component. The coil case has a coil-flange. Relative position of the plug case and the coil case are set each other by contact of the plug-flange and the coil-flange. Between the coil section and the plug section, a resinous lid is set to fill air space.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Figure 1:
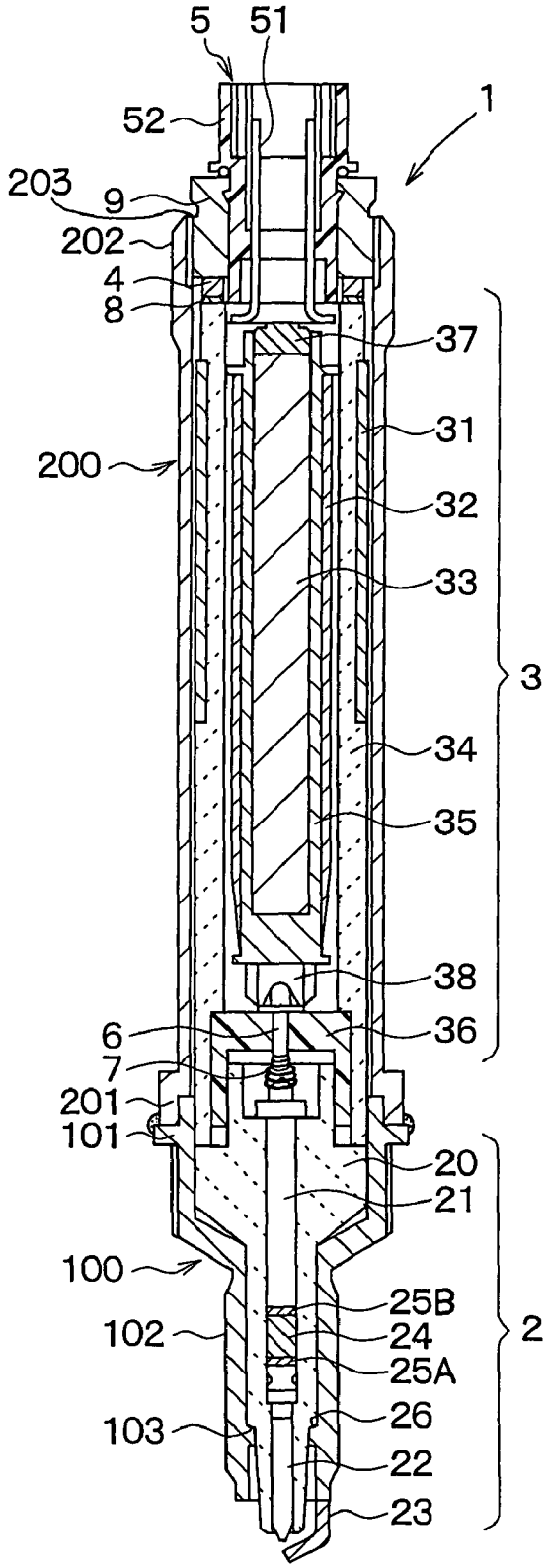
FIG. 1 is a cross-sectional side view of an ignition apparatus of an ignition apparatus according to the first embodiment.

An ignition apparatus 1 is shown in FIG. 1. The ignition apparatus 1 is inserted into a plug hole of a cylinder head (not shown). For convenience, the combustion chamber side (lower side in the FIG. 1) is defined as lower side (lower), and the opposite side of the combustion chamber (upper side in the FIG. 1) is defined as upper side (upper), regardless of actual allocation of the ignition apparatus 1.

The ignition apparatus 1 comprises separated two cases which are a cylindrical plug case 100 and a cylindrical coil case 200. The plug case 100 is positioned lower side of the coil case 200. The plug case 100 accommodates a plug section 2. The coil case 200 accommodates a coil section 3 and a pressure sensor 4.

The plug case 100 is made of carbon steel, which is conductive and is suitable for forging work. The coil case 200 is made of silicon steel plate which has excellent magnetic property.

The plug case 100 has a plug-flange 101 as its upper end section. The coil case 200 has a coil-flange 201 as its lower end section. By engaging of the plug-flange 101 and the coil-flange 201, relative position between the plug case 100 and the coil case 200 is fixed in axial direction and in radial direction. The engaged plug-flange 101 and the coil-flange 201 are welded at outer peripheral surfaces thereof to be integrated into a single unit.

The plug case 100 has male threads on the outer periphery of its upper section. The coil case 200 has a nut section 202 on the outer periphery of its upper section. The integrated ignition apparatus 1 is screwed by its nut section 202 and mounted on the cylinder head.

The plug section 2 comprises a stepped cylindrical insulator 20, a column-shaped flanged stem 21, a columned center electrode 22, a ground electrode 23, a resistive element 24 and two seals 25A, 25B. The insulator 20 is made of insulative material such as alumina ceramics. The stem 21 and the center electrode 22 and the ground electrode 23 are made of conductive metal. The resistive element 24 is made of glass including carbon powder, and has resistance of more than 3 kΩ. The seal 25A and 25B are made of mainly glass including copper.

The insulator 20 has a stepped working face 26 on its lower outer periphery. The plug case 100 has a stepped receiving face 103 on its lower inner periphery. The insulator 20 is mounted on the inner stepped receiving face 103 of the plug case 100 at its outer stepped working face 26. Relative position between the insulator 20 and the plug case 100 is fixed in the axial direction. Furthermore, combustion gas is sealed at the contacting of the stepped working face 26 and the stepped receiving face 103.

Inside of the center hole of the insulator 20, the center electrode 22, the first seal 25A, the resistive element 24, the second seal 25B and the stem 21 are disposed in order. The lower end of the center electrode 22 is exposed to the combustion chamber. The ground electrode 23 is connected with the plug case 100 by welding or the like, and faces the center electrode 22 each other. The seals 25A, 25B are made of highly conductive material, and avoid leakage of combustion gas through the center hole of the insulator 20.

The coil section 3 comprises a primary coil 31, a secondary coil 32, a columned center core 33, a cylindrical primary spool 34 and a bottomed cylindrical secondary spool 35. The center core 33 is made of magnetic material. The primary spool 34 is made of insulative material such as alumina ceramics. The secondary spool 35 is made of nonconductive resin.

The coil section 3 has connection members such as a high voltage terminal 38, an intermediate electrode 6, a coil spring 7. The high voltage terminal 38, the intermediate electrode 6 and the coil spring 7 are made of conductive metal such as stainless.

The primary coil 31 is wound on the outer periphery of the primary spool 34. The ends of the primary coil 31 are wired with a connector terminal 51 of the connector 5. Control signals from an ignition apparatus (not shown) are transmitted via the connector terminal 51.

The secondary coil 32 is wound on the outer periphery of the secondary spool 35. On the lower side of the secondary spool 35, the high voltage terminal 38 is mounted. The secondary coil 32 is wired with the high voltage terminal 38 at its high voltage end. The low voltage end of the secondary coil 32 is wired with the coil case 200. The coil case 200 is grounded to the chassis of a vehicle (not shown) via the cylinder head or the like.

In the center hole of the cylindrical secondary spool 35, the center core 33 is inserted, and is plugged by a presser lid 37 from the upper side pressing the center core 33. The presser lid 37 is made of elastomer such as rubber or sponge.

The secondary spool 35, the secondary coil 32, the center core 33 and the presser lid 37 are assembled into a single unit, and are inserted into the center hole of the cylindrical primary spool 34 all together. The lower end opening of the primary spool 34 is plugged by a lid 36. The lid 36 is made of nonconductive resin such as silicone. On the lid 36, a flanged column-shaped intermediate electrode 6 is mounted. The upper end of the intermediate electrode 6 electrically contacts the high voltage terminal 38 on the lower side of the secondary spool 35.

In the center hole of the primary spool 34 assembled as described above, nonconductive resin is injected from the upper opening. The resin cures after flowing into the gap between the primary spool 34 and the secondary coil 32, and bond together.

The lower end of the intermediate electrode 6 penetrates the lid 36 toward the lower direction, and is protruded on the lower surface of the lid 36. The protruded lower end of the intermediate electrode 6 has an annular trench in the outer peripheral surface. The coil spring 7 hooks on the annular trench so that the coil spring 7 connects with the intermediate electrode 6 tightly.

The coil spring 7 is further connected with the stem 21. The stem 21 has a tapered end (conically-shaped head) on its upper side. The tapered end surface electrically contacts the lower end of the coil spring 7 centering the coil spring 7 not to be misaligned. The stem 21 is further connected with the second seal 25B, the resistance element 24, first seal 25A and center electrode 22 inside of the insulator 20.

The nonconductive lid 36 is disposed between the plug section 2 and the coil section 3, and fills the air space to prevent the high voltage from leaking via the air space.

In the present embodiment, the connection member includes the high voltage terminal 38, the intermediate electrode 6, the coil spring 7, the stem 21, the resistance element 24 and the seal 25A, 25B.

The nut section 202 forms the end brim of the coil case 200. Near the brim of the nut section 202, a ring-shaped pressure sensor 4 is disposed with a ring-shaped sensor terminal 8 on the upper end surface of the primary spool 34. The upper end of the primary spool 34 protrudes from both upper ends of the primary coil 31 and the secondary coil 32 so that the pressure sensor 4 can be put on easily from the brim of the nut section 202.

The pressure sensor 4 has such a property that its output voltage varies as applied pressure changes. The pressure sensor 4 is made of lead titanate or the like. The sensor terminal 8 and a connector terminal 51 are made of conductive metal, and are formed integrally.

On the inner peripheral surface of the nut section 202, a female thread 203 is formed. A cylindrical bolt 9 is screwed into the nut section 202, and the pressure sensor 4 and the terminal 8 are fixed between the upper end surface of the primary spool 34 and lower end surface of the bolt 9. One wire end of the pressure sensor 4 is connected with the coil case 200 via the bolt 9. The other wire end is connected with the terminal 8. Pressure detection signals are transmitted to an outer control system (not shown) via the terminal 8.

Figure 2A:
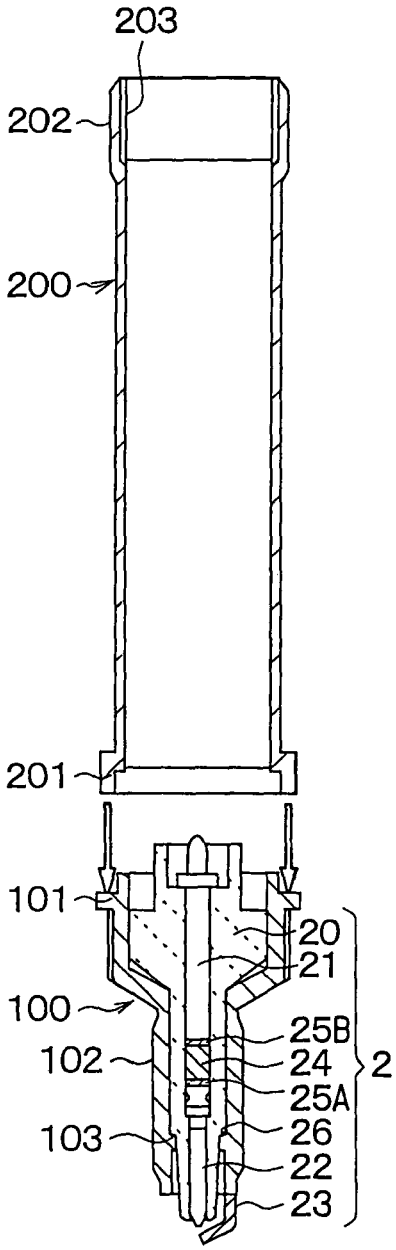
FIG. 2A and FIG. 2B are cross-sectional side views of an ignition apparatus showing an assembly of the ignition apparatus in FIG. 1.

As shown in FIG. 2A, the components of the plug section 2 are accommodated into the plug case 100, and the coil case 200 is engaged onto the plug case 100 by contacting both faces of the coil-flange 201 and the plug-flange 101.

Figure 2B:
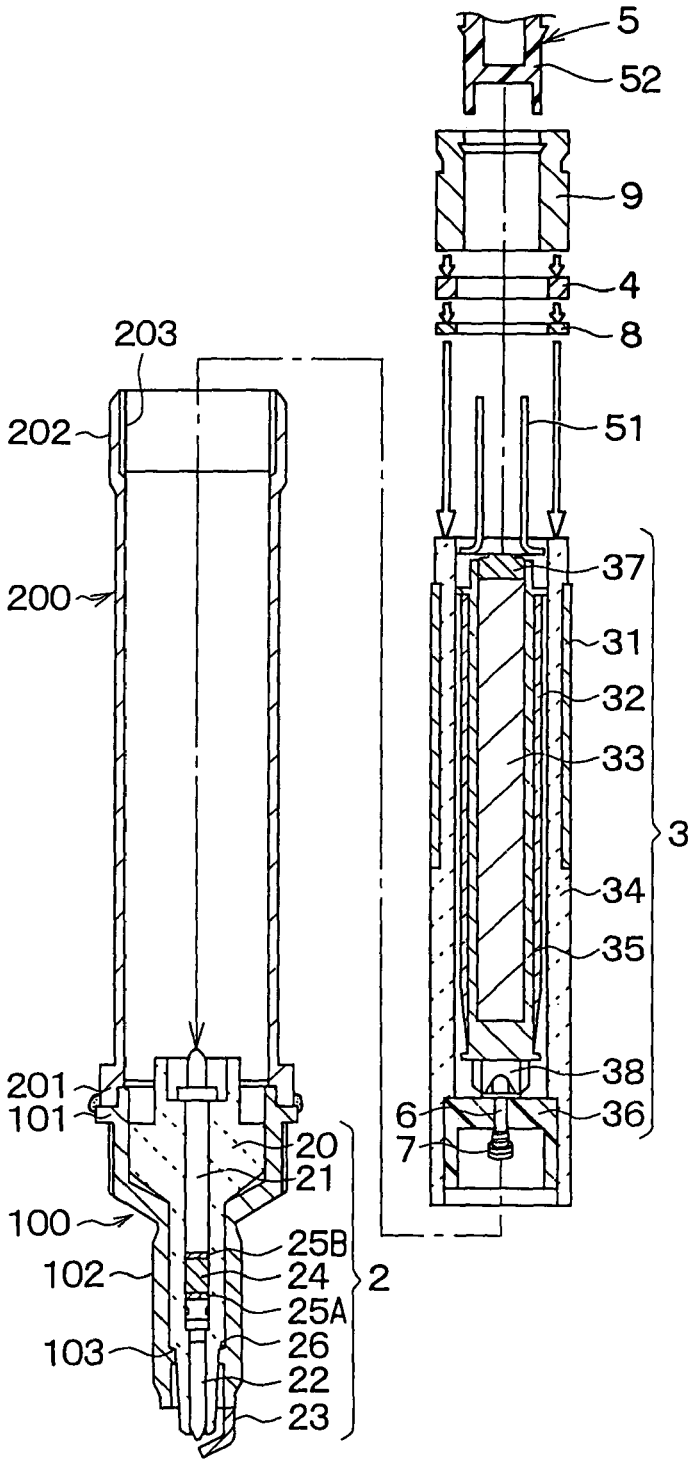

As shown in FIG. 2B, the coil-flange 201 and the plug-flange 101 are welded at both outer peripheries to be integrated. The assembled coil section 3 is inserted into the coil case 200 so that the spring 7 contacts the stem 21. The pressure sensor 4 and the terminal 8 are inserted into the nut section 202 and set on the upper surface of the primary spool 34. The bolt 9 is screwed into the nut section 202 at the female thread 203 to be fixed. A resinous case 52 of the connector 5 is inserted into the center hole of the bolt 9.

As shown in FIG. 1, as the bolt 9 is screwed up toward the lower side, and is tightened, the coil spring 7 is pressed to deform resiliently in its axial direction. The primary spool 34, which floats against the insulator 20 by spring force of the coil spring 7, is pressed onto the insulator 20. The hollow lower end of the primary spool 34 is fixed around the protruded upper section of the insulator 20. Thus, by the resilient deformation of the coil spring 7, spring-back force is generated. The coil spring 7 is pressed onto the stem 21 and electrical contact is strengthened.

After the primary spool 34 contacts the upper end of the insulator 20, the bolt 9 is further tightened, so that the pressure sensor 4 is preloaded. The stepped working face 26 of the insulator 20 is pressed and fits onto the receiving face 103 of the plug case 100.

In the above ignition apparatus 1, the coil section 3 generates high voltage corresponding to the control signals from an external device (not shown), and the plug section 2 sparks at its spark gap energized by the generated high voltage. The sparks ignite mixture gas in the combustion chamber. Generated pressure by the combustion applies force onto the pressure sensor 4 via the insulator 20 and the primary spool 34. The pressure sensor 4 transmits the pressure detection signal corresponding to the applied force.

In this embodiment, contact between the coil spring 7 and the stem 21 is sustained by spring-back force of the coil spring 7. Detachment between the coil spring 7 and the stem 21 is not apt to be caused. Thus, electric conduction failure between the center electrode 22 and the secondary coil 32 can be prevented.

At the joint section between the coil case 200 and the plug case 100, the coil-flange 201 can be smaller than the plug-flange 101 in diameter.

The upper end of the stem 21 can be smaller than the coil spring 7 in diameter. In this case, the end of the stem 21 is inserted into the coil spring 7, and the lowermost end of the coil spring 7 contacts the uppermost flange face of the stem 21.

Figure 4A:
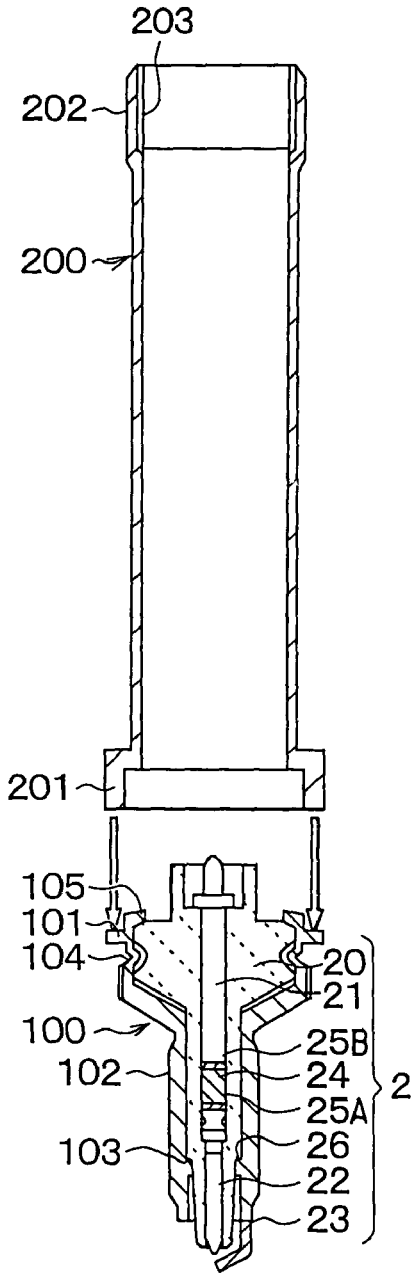
FIG. 4A and FIG. 4B are cross-sectional side views of an ignition apparatus showing an assembly of the ignition apparatus in FIG. 3.

In the second embodiment, as shown in FIG. 4A, the plug case 100 has a hot crimping section 104 and a cold crimping section 105 peripherally. The hot crimping section 104 is on the lower side of the plug-flange 101, and the cold crimping section 105 is on the upper side of the plug-flange 101.

After accommodating the plug section 2 into the plug case 100, the hot crimping section 104 is heated and softened. Subsequently, the cold crimping section 105 is pressed in the axial direction of the plug case 100, and is crimped so that its brim deforms into the radially inner direction. Simultaneously, the heated crimping section 104 is pressed in the axial direction to cause buckling into the radially inner direction. The inner periphery of the crimping section 104 presses the outer periphery of the insulator 20, and seals the peripheral gap thereof.

Figure 3:
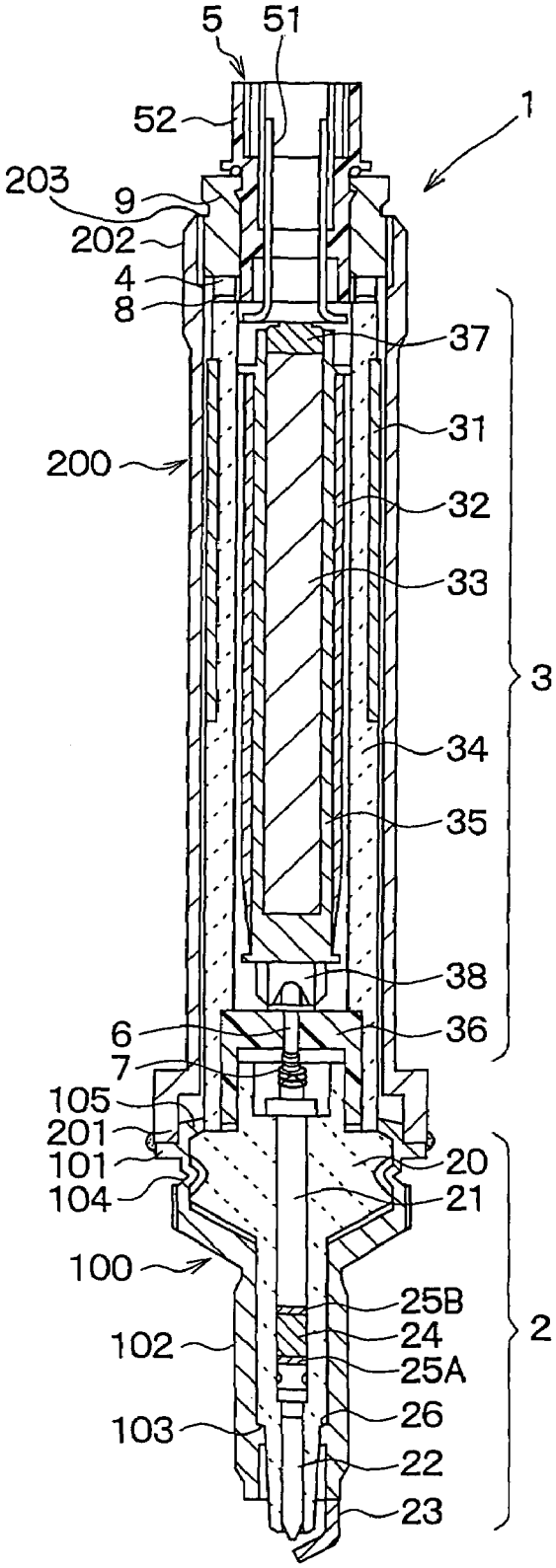
FIG. 3 is a cross-sectional side view of an ignition apparatus of the second embodiment.
Figure 4B:
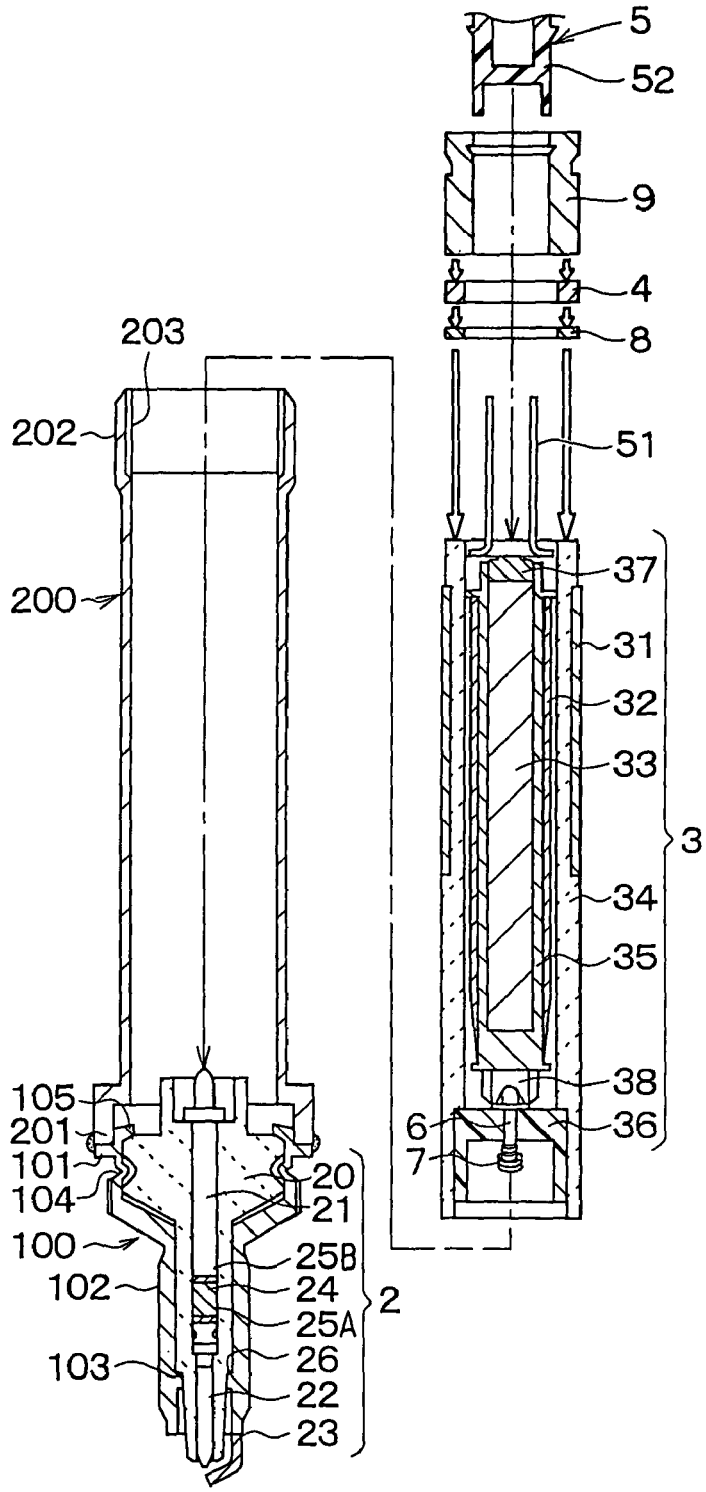

As shown in FIG. 4B, after the hot crimping, the plug case 100 is joined and welded with the coil case 200. Finally, the ignition apparatus 1 is manufactured as shown in FIG. 3.

Figure 6:
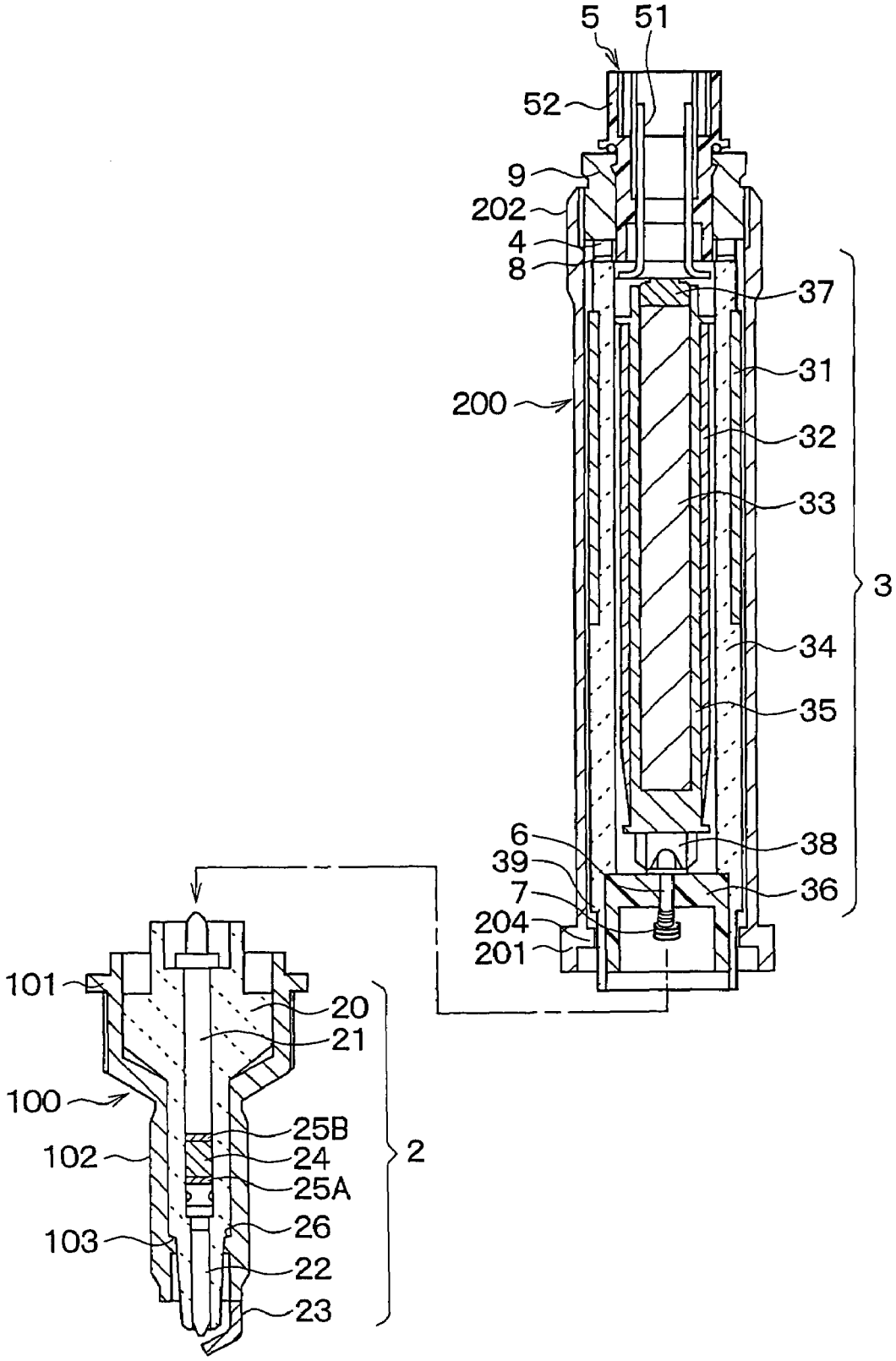
FIG. 6 is a cross-sectional side view of an ignition apparatus showing an assembly of the ignition apparatus in FIG. 5.

In the third embodiment, as shown in FIG. 6, at lower end of the coil case 200, a receiving step 204 is protrusively formed on its inner wall into the radially inner direction. The outer periphery of the primary spool 34 is stepped (hooking step 39) at its lower end. The hooking step 39 hooks on the upper face of the receiving step 204.

In assembling, the coil section 3, the terminal 8, the pressure sensor 4, the bolt 9, the connector 51 and the case 52 can be built in the coil case 200 before joining the coil case 200 and the plug case 100. The hooking structure between the hooking step 39 and the receiving step 204 avoids dropping off of the inner components of the coil case 200.

Figure 5:
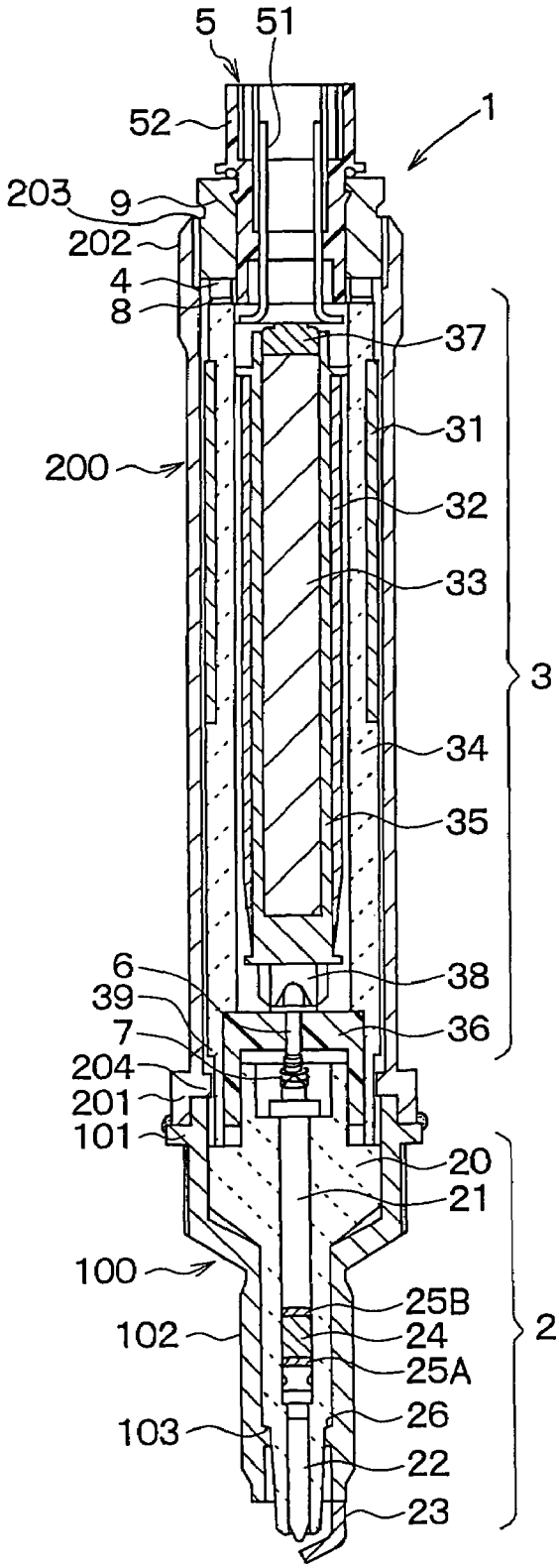
FIG. 5 is a cross-sectional side view of an ignition apparatus of the third embodiment.

As shown in FIG. 5, after integrating and welding of the coil case 200 and the plug case 100, the bolt 9 is further screwed to preload the pressure sensor 4 and to press the coil spring 7, thereby fitting stepped working face 26 onto the receiving face 103.

Figure 7:
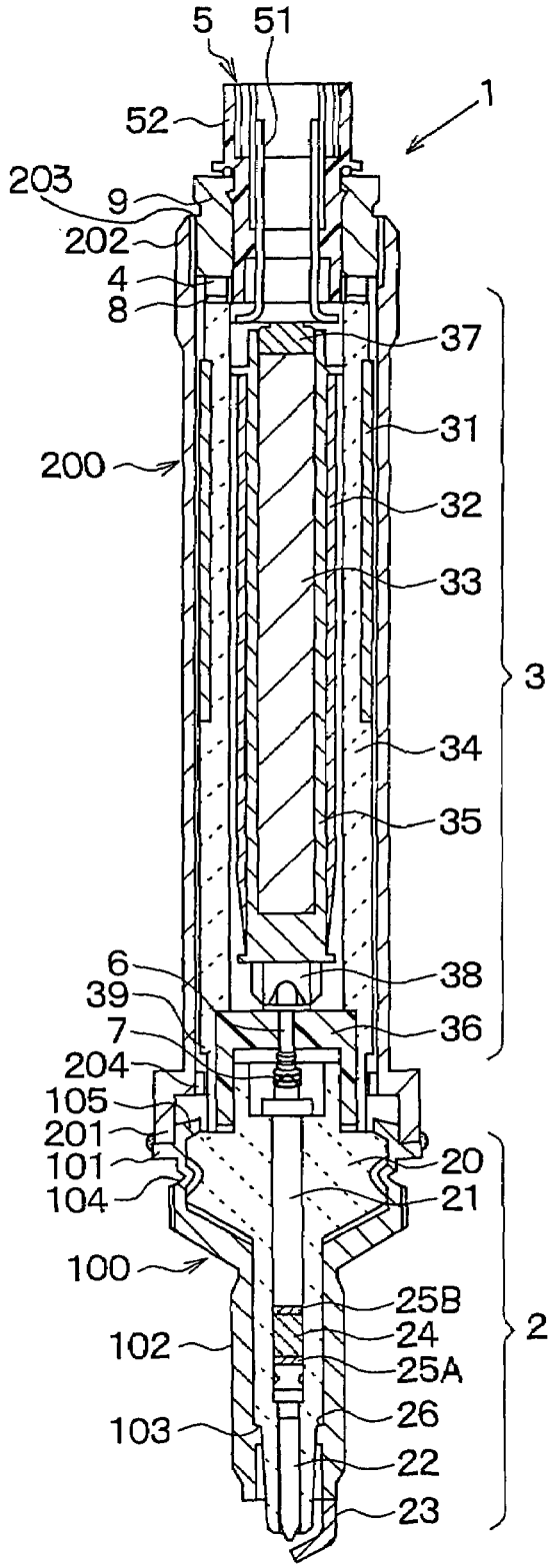
FIG. 7 is a cross-sectional side view of an ignition apparatus of the fourth embodiment.
Figure 8:
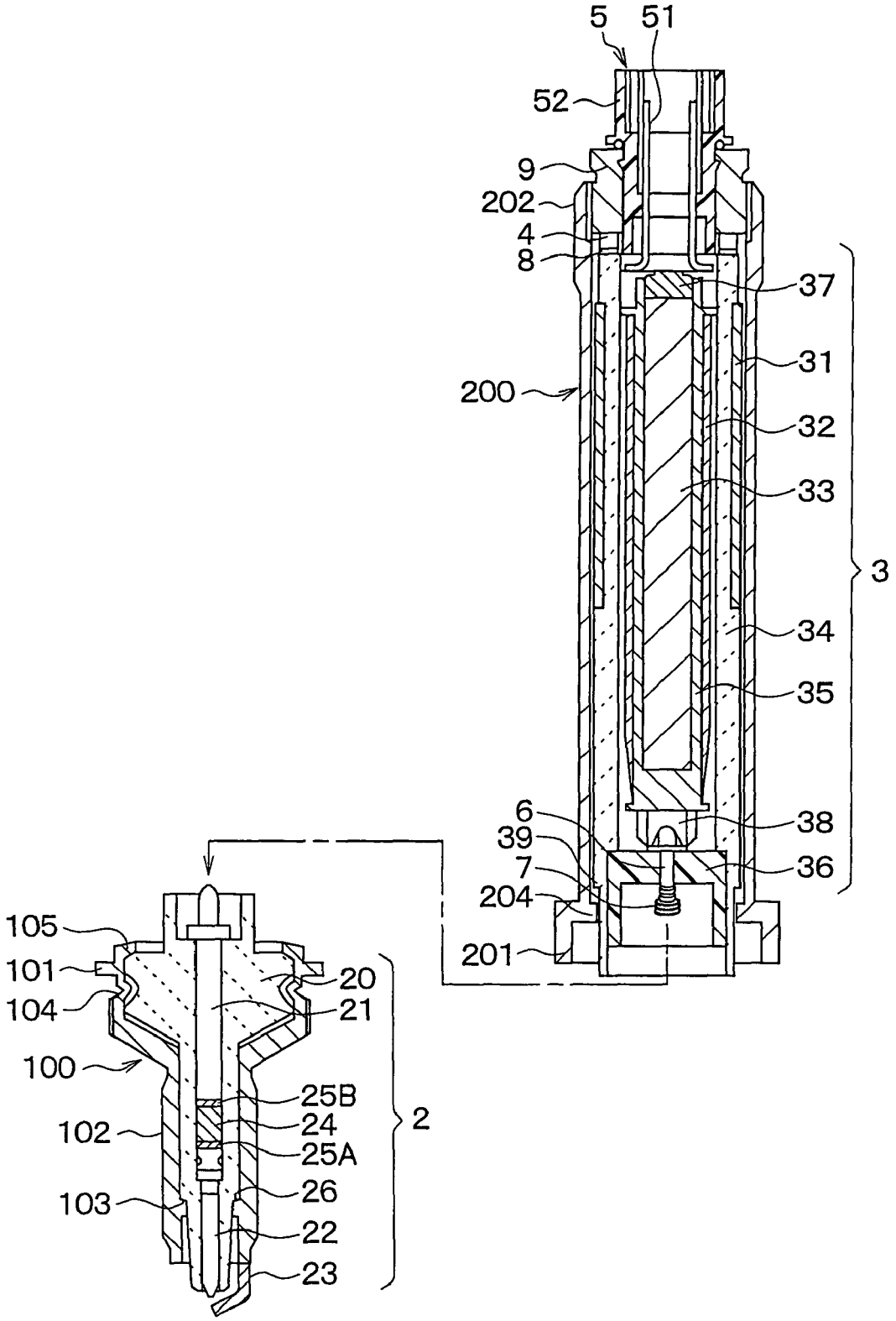
FIG. 8 is a cross-sectional side view of an ignition apparatus showing an assembly of the ignition apparatus in FIG. 7.

In the fourth embodiment, as shown in FIG. 7 and FIG. 8, the plug case 100 has the hot crimping section 104 and the cold crimping section 105 as shown in FIG. 3 (second embodiment). Additionally, the coil case 200 has a receiving step 204, and the primary spool 34 has a hooking step 39 as shown in FIG. 5 (third embodiment).

Figure 9:
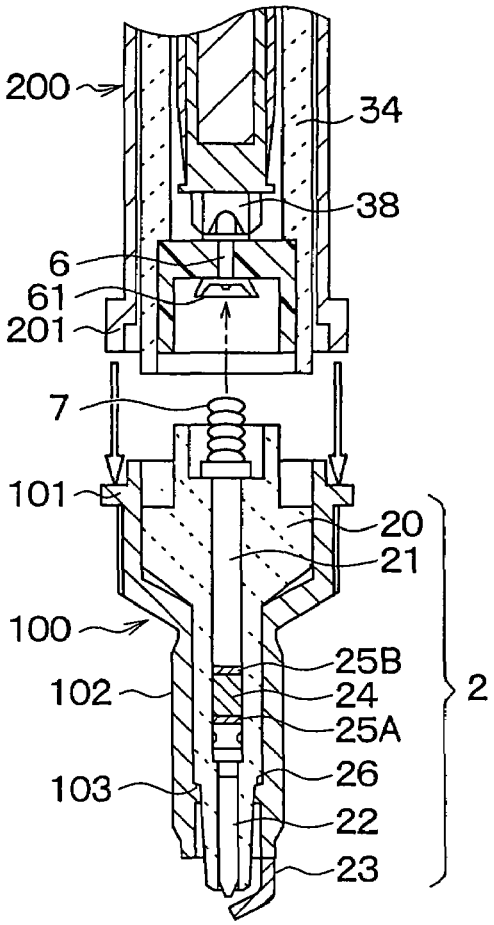
FIG. 9 is a cross-sectional side view of an ignition apparatus of the fifth embodiment.

In the fifth embodiment, as shown in FIG. 9, the coil spring 7 is mounted on the stem 21. On the lower end of the intermediate electrode 6, a dish-shaped end terminal 61 is joined by welding or crimping. The end terminal 61 is made of a conductive metal such as stainless steel or brass.

Figure 10:
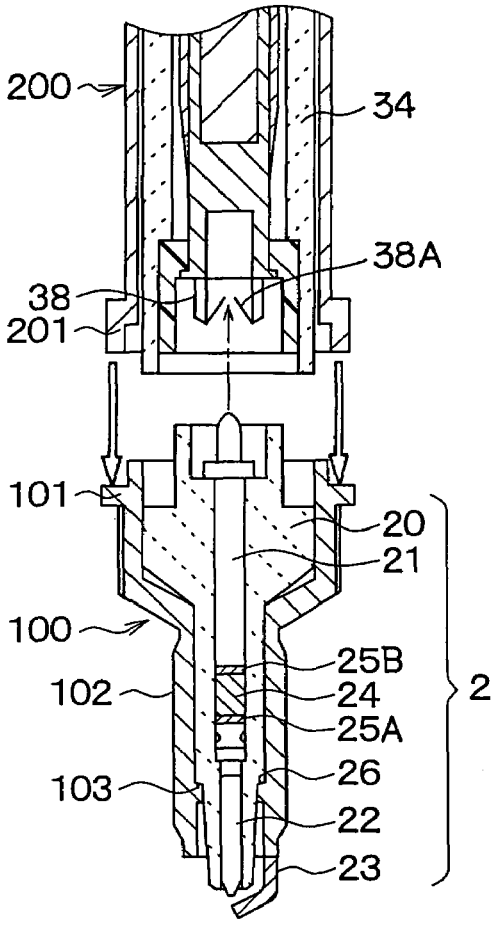
FIG. 10 is a cross-sectional side view of an ignition apparatus of the sixth embodiment.

In sixth embodiment, as shown in FIG. 10, the high voltage terminal 38 are blade springs made of conductive metal such as stainless steel or brass. In detail, the high voltage terminal 38 has radially opposing two thin metal leaves 38A. The leaves 38A can deform resiliently in the radial direction of the coil case 200. In assembling, the stem 21 is inserted into the center of the two leaves 38A. The two leaves 38A are shoved, and are resiliently deformed in the diametric direction by the inserted stem 21, and electrical contact is maintained by the spring-back force. In this embodiment, the high voltage terminal 38 contacts the stem 21 directly, and mid electrode can be omitted.

Figure 11C:
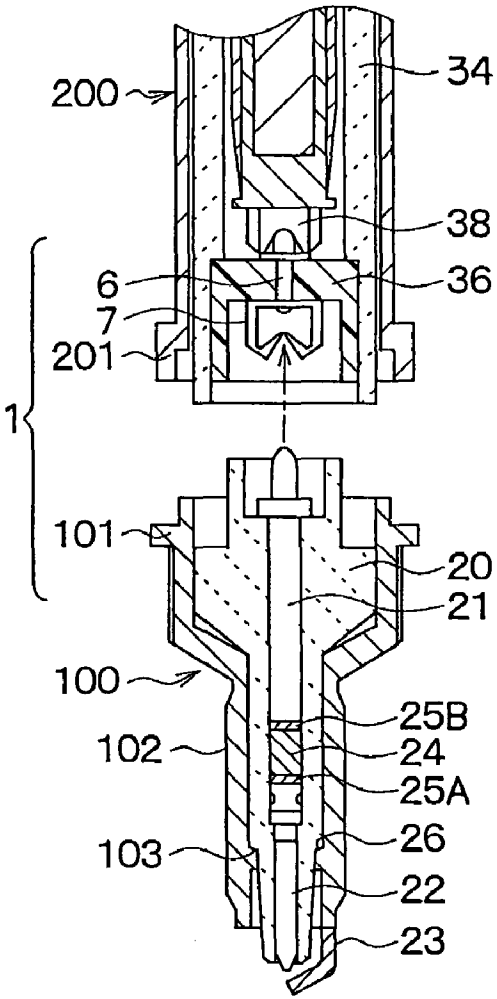
FIG. 11A, FIG. 11B and FIG. 11C are cross-sectional side views of an ignition apparatus of the seventh embodiment.
Figure 11B:
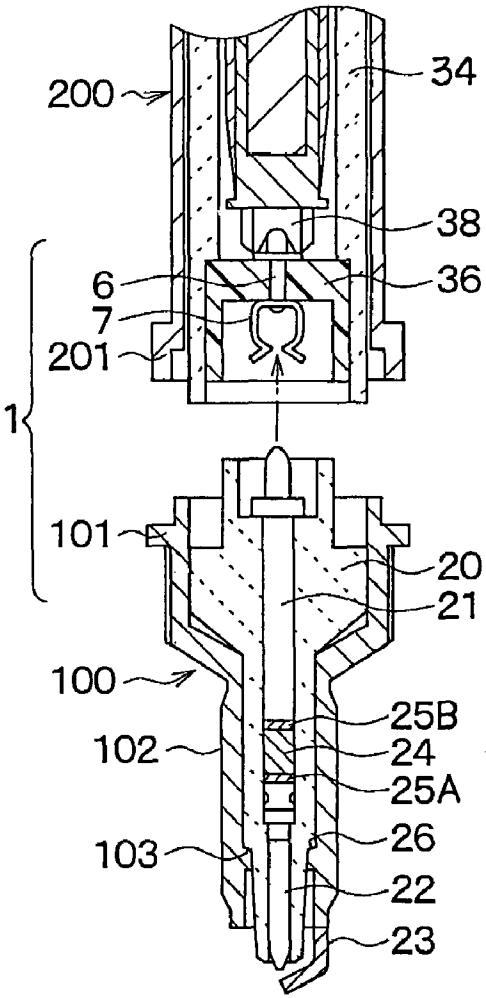
Figure 11A:
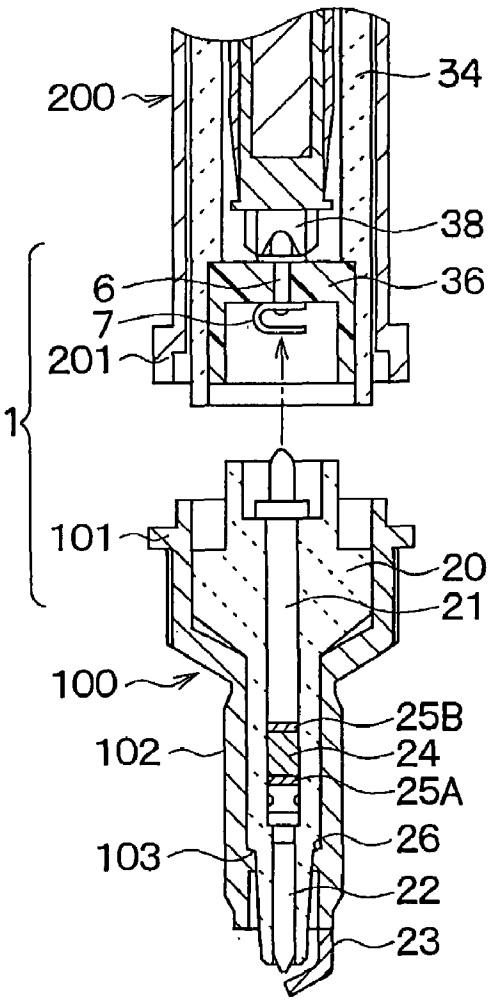

In the seventh embodiment, as shown in FIG. 11A, FIG. 11B and FIG. 11C, the spring 7 is a blade spring shaped differently from the coil spring 7 in the first embodiment. As shown in FIG. 11A, the spring 7 is a U-shaped and joined on the intermediate electrode 6 by crimping or welding. As shown in FIGS. 11B and 11C, the spring 7 has radially opposing two thin metal leaves.

Figure 12A:
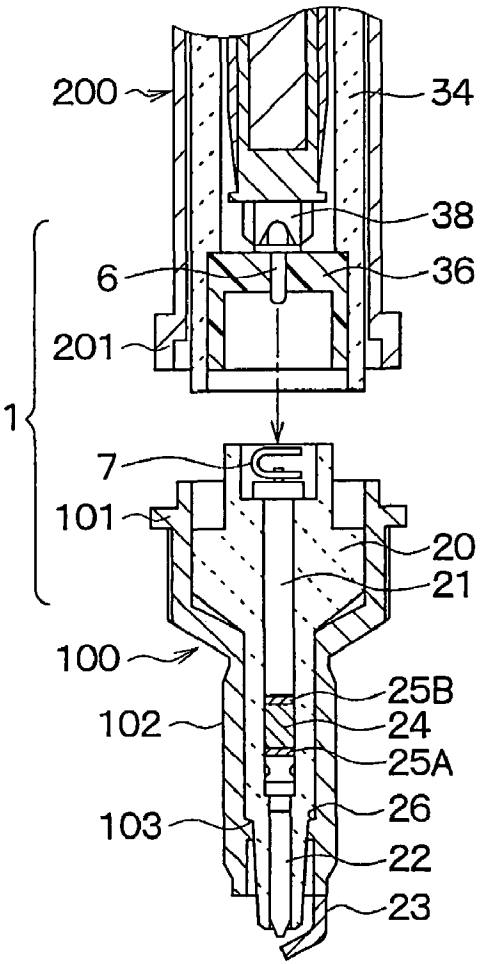
FIG. 12A, FIG. 12B and FIG. 12C are cross-sectional side views of an ignition apparatus of the eighth embodiment.
Figure 12B:
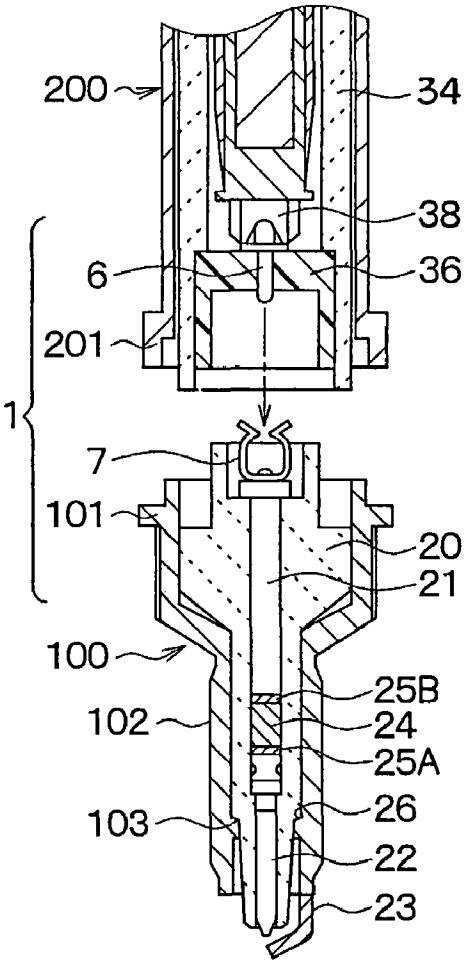
Figure 12C:
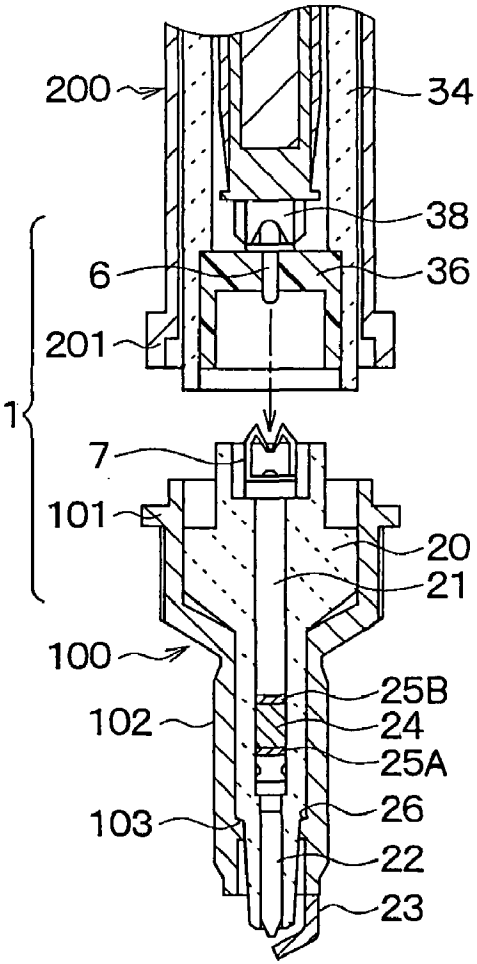

In the eighth embodiment, as shown in FIG. 12A, FIG. 12B and FIG. 12C, the springs 7 are joined on the stem 21.

Figure 13A:
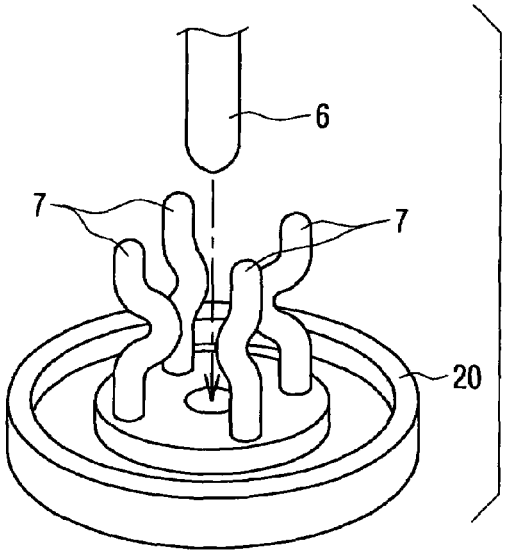
FIG. 13A, FIG. 13B and FIG. 13C are cross-sectional side views of an ignition apparatus of the ninth embodiment.
Figure 13B:
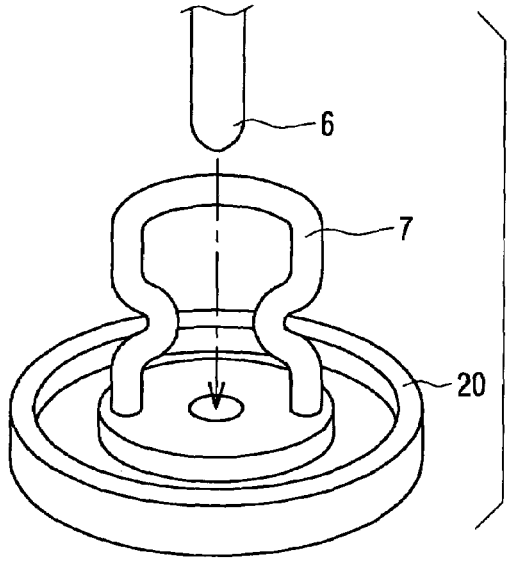
Figure 13C:
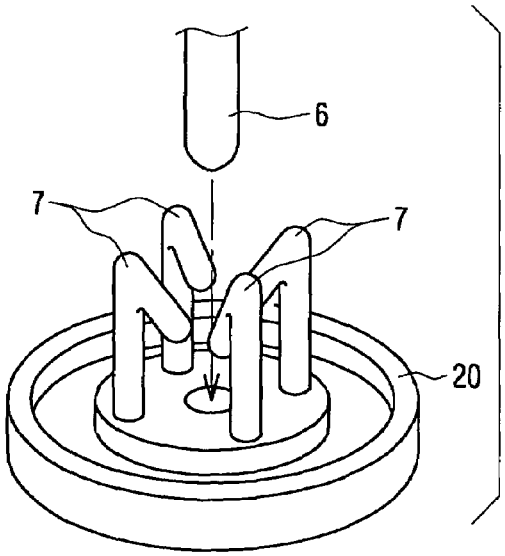

In the ninth embodiment, as shown in FIG. 13A, FIG. 13B and FIG. 13C, the spring 7 is made of a bent conductive wire. The spring 7 resiliently deforms when the intermediate electrode 6 is inserted.

Various modifications and alternation may be made to the above embodiments without departing from the spirit of the present invention.

What is claimed is:

1. An ignition apparatus for an engine having a cylinder head on a combustion chamber thereof, said apparatus comprising:

a plug section including a center electrode and a ground electrode;

a hollow plug case including the plug section and having a first flange;

a hollow coil case including the coil section and having a second flange; and a coil section integrated with the plug section and including a primary coil and a secondary coil to supply a high voltage to the plug section, wherein the plug section and the coil section have inner connection members contacting each other in a resiliently deformed condition to make electrical connection between the center electrode of the plug section and the secondary coil of the coil section; and wherein the first flange and the second flange are engaged with each other and welded to fix the plug case and the coil case.

2. An ignition apparatus according to claim 1, wherein the connection members include a coil spring.

3. An ignition apparatus according to claim 2, wherein the connection members include a columned connection member having a trench in a peripheral surface thereof for engagement with the coil spring.

4. An ignition apparatus according to claim 2, wherein the connection members include a columned connection member having a conical end surface to receive an end of the coil spring.

5. An ignition apparatus according to claim 1, wherein the connection members include a blade spring.

6. An ignition apparatus according to claim 1, wherein the connection members include a spring made of a bent wire.

7. An ignition apparatus according to claim 1, wherein the inner connection members include a resilient spring and a stem, which are separately engaged with each other.

8. An ignition apparatus according to claim 1, further comprising:

a lid made of nonconductive resin and disposed between the plug section and the coil section.

9. An ignition apparatus for an engine having a cylinder head on a combustion chamber thereof comprising:

a plug section including a center electrode and a ground electrode and a first connection member;

a coil section integrated with the plug section and including a primary coil, a secondary coil and a second connection member connected with the secondary coil to supply a high voltage to the plug section; and a hollow coil case accommodating the coil section and having a bolt screwed in an opening at a location opposite the second connection member, wherein the first connection member and the second connection member are connected to each other to make electrical connection between the center electrode of the plug section and the secondary coil of the coil section, and wherein the bolt presses the second connection member to the first connection member via the coil section.

* * * * *